US006244010B1

(12) United States Patent
Sluiter

(10) Patent No.: US 6,244,010 B1
(45) Date of Patent: Jun. 12, 2001

(54) SNAP-IN LATERAL TRUSS BRACE

(76) Inventor: Scott E. Sluiter, 4900 168th Ave., Holland, MI (US) 49424

( * ) Notice: Subject to any disclaimer, the term of this patent is extended or adjusted under 35 U.S.C. 154(b) by 0 days.

(21) Appl. No.: 09/316,936

(22) Filed: May 21, 1999

(51) Int. Cl.[7] ..... E04C 3/02; E04C 5/18

(52) U.S. Cl. ..... 52/643; 52/639; 52/654.1; 52/664; 52/665; 52/669; 52/696; 52/697; 52/703; 52/741.1

(58) Field of Search ..... 52/639, 643, 654.1, 52/696, 697, 703, 741.1, 664, 665, 669

(56) References Cited

U.S. PATENT DOCUMENTS

| | | | | |
|---|---|---|---|---|
| 1,685,729 | * | 9/1928 | Stone . | |
| 2,300,113 | | 10/1942 | Faber . | |
| 2,442,726 | * | 6/1948 | Gstalder . | |
| 2,631,809 | * | 3/1953 | Jacobson . | |
| 3,233,297 | * | 2/1966 | Havener | 52/665 X |
| 3,714,752 | * | 2/1973 | Ratliff, Jr. | 52/665 X |
| 3,778,952 | | 12/1973 | Soucy . | |
| 3,925,948 | | 12/1975 | Sauer et al. . | |
| 4,018,020 | | 4/1977 | Sauer et al. . | |
| 4,448,004 | | 5/1984 | Thorsell . | |
| 4,791,766 | | 12/1988 | Egri, II . | |
| 4,837,988 | | 6/1989 | Menchetti et al. . | |
| 4,850,169 | | 7/1989 | Burkstrand et al. . | |
| 4,858,407 | | 8/1989 | Smolik . | |
| 5,515,660 | | 5/1996 | Hanks et al. . | |
| 5,606,837 | | 3/1997 | Holizlander . | |
| 5,884,448 | * | 3/1999 | Pellock | 52/643 |

FOREIGN PATENT DOCUMENTS

| | | |
|---|---|---|
| 1431312 | 4/1976 | (GB) . |

* cited by examiner

*Primary Examiner*—Christopher T. Kent
(74) *Attorney, Agent, or Firm*—Price, Heneveld, Cooper, DeWitt & Litton

(57) ABSTRACT

A cross-bracing kit for laterally spacing and bracing open web structural supports comprises at least two clips wherein each clip includes an attachment portion for attaching to the truss member and has a first finger and a second finger extending from the attachment portion in a cantilevered fashion. The fingers define a channel therebetween and each finger includes a nib at a free end of the finger. The nibs face each other and define an opening between the ends of the nib that is narrower than the channel defined by the fingers. The kit further includes at least one cross-brace which has a channel-like cross section that includes a first leg and a second leg connected at their respective bottoms. The cross-brace further includes at least two notches in a bottom of the brace wherein a distance corresponding to a desired spacing of adjacent supports separates the notches.

34 Claims, 4 Drawing Sheets

SNAP-IN LATERAL TRUSS BRACE

BACKGROUND OF THE INVENTION

Open web structural supports in general, and in particular, structural trusses are used for the fabrication of buildings in the construction industry. Open web supports are used to form a variety of building structural segments, while the primary application of structural trusses is to define a desired roofline and to support the roof by the building walls and interior structure. Trusses are typically fashioned from a series of joined vertical, horizontal, and angled members. Historically, trusses have been fabricated from wooden members joined by flat metal plates having a plurality of spiked projections therefrom for driving the plates into the wooden members and retaining the members in a joined relationship.

In recent years, metal trusses and metal open web structural supports have gained favor in the construction industry. Metal supports are typically comprised of metal U-channels and square tubular members with the members being joined by mechanical fasteners.

When added to a building structure, metal supports are primarily in a parallel spaced apart relationship. The triangular construction of the supports make them particularly strong with respect to forces applied within the plane of the support. However, because the supports are primarily planar in nature, they are vulnerable to buckling when lateral forces are applied to the supports. Consequently, to further rigidify the building structure created by the supports, lateral or cross-bracing between supports must be added. The cross-braces extend between a plurality of supports wherein the brace is fastened to the support using mechanical fasteners. The attachment points of the cross-brace to the supports are typically determined by individually measuring the proper spacing between supports to insure proper alignment. Such a process is time consuming and adds to the construction time and effort during the erection of the building.

There is a need for a cross-bracing system which is easy to install, provides accurate placement of the supports, and provides sturdy cross-bracing of the supports to prevent buckling.

SUMMARY OF THE INVENTION

One aspect of the present invention is a cross-bracing kit for laterally spacing and bracing open web structural supports. The cross-bracing kit comprises at least two clips. Each clip includes an attachment portion for attaching to a support member, and has a first finger and a second finger extending from the attachment portion in a cantilevered fashion. The fingers define a channel therebetween and each finger includes a nib at a free end of the finger. The nibs face each other and define an opening between the ends of the nib that is narrower than the channel defined by the fingers. The kit further includes at least one cross-brace which has a channel-like cross section that includes a first leg and a second leg connected at their respective bottoms. The cross-brace further includes at least two notches in a bottom of the brace wherein the notches are separated one from the other by a distance corresponding to a desired spacing of adjacent supports.

Another aspect of the invention is a cross-braced open web structural support system comprising at least two supports separated one from the other, and at least one clip attached to each support. Each of the clips includes an attachment portion abutting a first surface of the support and has a first finger and a second finger extending in parallel cantilevered fashion from the attachment portion. The fingers define a channel therebetween, with each finger including a nib at a free end of the finger such that the nibs are facing each other and define an opening therebetween which is narrower than the channel defined by the fingers. There is at least one cross-brace extending between the two trusses. The brace has a channel-like cross section including a first leg and a second leg connected at their respective bottoms and further including at least two notches in a bottom of the brace. Each notch engages one of the clips and a portion of one of the supports, and further wherein the notches are separated one from the other by a distance corresponding to a desired spacing of adjacent supports.

Yet another aspect of the present invention is a method of cross-bracing supports comprising the steps of first attaching at least one clip to each of a plurality of supports. Each clip includes an attachment portion abutting a first surface of the support and further includes a first and second finger extending in parallel cantilevered fashion from the attachment portion defining a channel therebetween. Each finger includes a nib at a free end of the finger with the nibs facing each other and defining an opening between the nibs, which is narrower than the channel. The supports are arranged in a desired placement wherein at least adjacent clips are laterally aligned when the supports are in their desired placement. A cross-brace is placed to extend between at least two adjacent supports wherein the cross-brace has a channel-like cross section including a first leg and a second leg connected at their respective bottoms and further including at least two notches in a bottom of the brace. The notches are separated one from the other a distance corresponding to a desired spacing of adjacent supports with each notch aligned with one of the trusses. The cross-brace is engaged in the clip channel such that each notch engages a portion of the respective support, and the nibs of each clip engage respective legs of the cross-brace.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
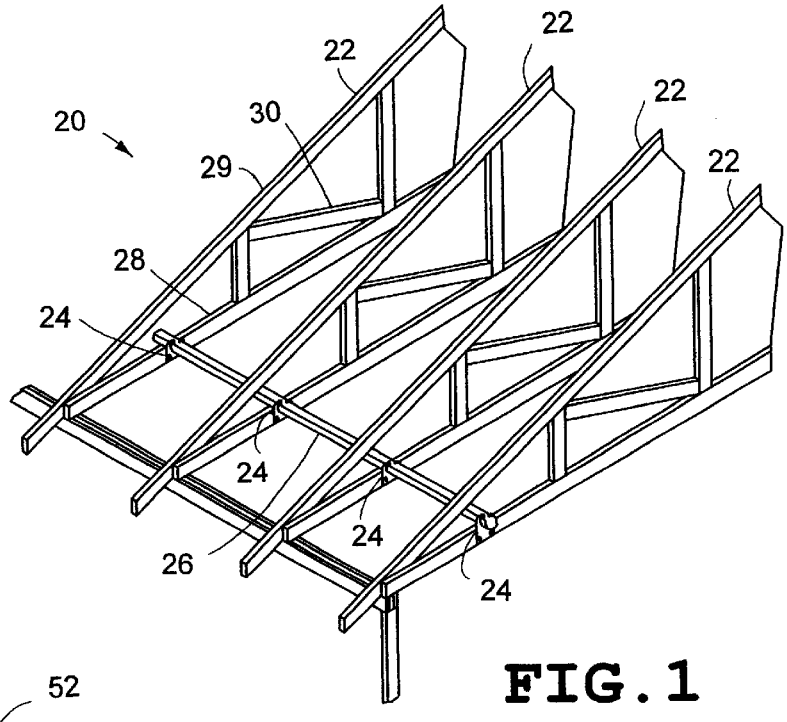
FIG. 1 is a perspective view of a plurality of roof trusses including a cross-bracing system embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Within this description, members of a truss referred to as chords are those horizontal or near horizontal members forming the bottom of the truss and those angled upper members defining a roofline. The truss members extending between chords and maintaining the chords in a spaced apart relationship are referred to as webs.

Turning to the drawings, FIG. 1 shows generally at 20 a plurality of trusses 22 interconnected and braced with cross-brace 26. While the cross-bracing system described herein is applicable to any open web structural support system, the preferred embodiment is directed to roof trusses, which are but one form of an open web structural support. Those skilled in the art will understand and appreciate the manner in which the truss cross-bracing described herein is applicable to other open web structural support configurations.

Cross-brace 26 is retained to each truss with at least one clip 24 attached thereto. It will be understood by those skilled in the art, that the cross-bracing system described herein can be attached to various portions of trusses 22 including bottom chords 28, top chords 29, or web members 30. It will be further understood that although FIG. 1 illustrates only one cross-brace 26 extending between trusses 22 a plurality of cross-braces 26 may be added across the span of trusses 22 to provide the desired degree of cross-bracing.

Figure 2:
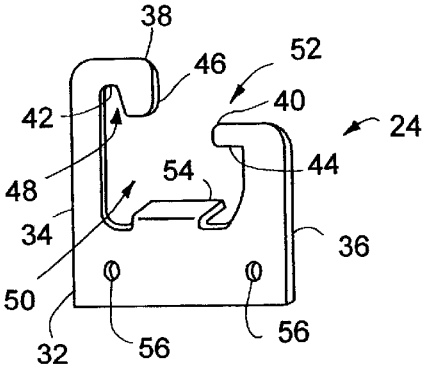
FIG. 2 is a perspective view of the clip for attachment to the truss.

Referring now to FIG. 2, a clip 24 according to the preferred embodiment of the present invention includes an attachment portion 32 for abutting attachment to a lateral face of a truss chord 28 or 29 or a truss web 30. Holes 56 may be preformed in attachment portion 32 for receipt of attachment fasteners and ease of attaching clip 24 to truss 22. A first finger 34 and a second finger 36 extend upwardly in a parallel cantilevered fashion from a top edge of attachment portion 32. First and second fingers 34 and 36 in combination with attachment portion 32 form a channel 50 therebetween. A tab 54 extends at a right angle from attachment portion 32. Tab 54 functions as a vertical locating device to rest on an upper edge of chords 28 or 29 or web member 30 to facilitate uniform vertical positioning of clip 24 with respect to the truss member to which it is attached. First finger 34 has a nib 38 extending inwardly into channel 50 from a top portion of finger 34 and further defines a shoulder 42 along a bottom edge of nib 38. Nib 38 can also include a depending portion 46 which defines in combination with finger 34 a downward opening slot 48. Second finger 36 also includes a nib 40 extending inwardly into channel 50 from a top portion of finger 36 and also defines a shoulder 44 at a bottom edge of nib 40. Fingers 34 and 36 can be either of equal length or, as in the preferred embodiment, first finger 34 can be longer than second finger 36.

Figure 3:
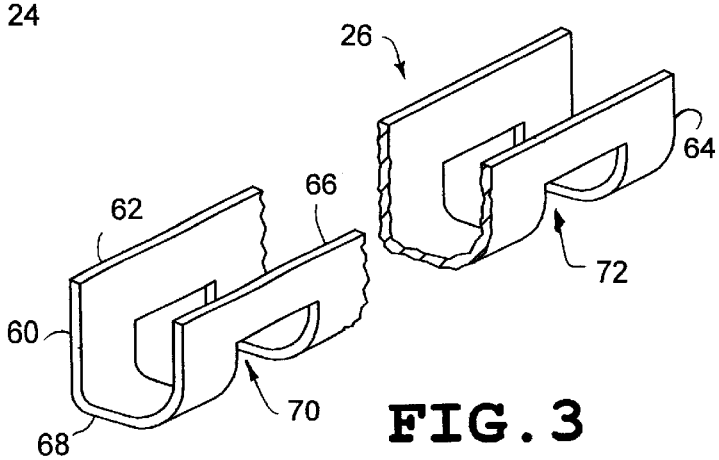
FIG. 3 is a broken perspective view of a cross-brace having notches in the bottom thereof.

Referring now to FIG. 3, a cross-brace 26 is shown in broken perspective. In the preferred embodiment, cross-brace 26 has a U-shaped cross section which includes a first leg 60 having a top edge 62 and a second leg 64 having a top edge 66. Cross-brace 26 has a bottom 68 joining the bottom of legs 60 and 64. The width of cross-brace 26 is substantially equal to the width of channel 50 defined by fingers 34 and 36 as shown in FIG. 2. Cross-brace 26 also includes at least first notch 70 and second notch 72 cut in the bottom 68 of cross-brace 26. Notches 70 and 72 are spaced along cross-brace 26 according to the desired spacing of trusses 22 one from another. It will be understood that cross-brace 26 can be of sufficient length and include a plurality of notches such that cross-brace 26 spans a plurality of trusses 22. Notches 70 and 72 are cut to a width corresponding to the width of the truss member on which they are to be engaged. The width of notches 70 and 72 in the case of a solid truss member may encompass the entire width of the truss member, or in the case of a U-shaped truss member can comprise a plurality of narrow notches 71 which engage individual flanges 31 of truss member 28 as shown in FIG. 7.

Figure 4:
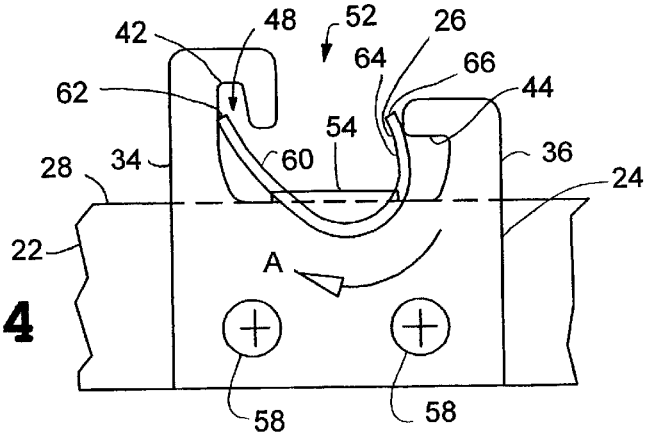
FIG. 4 is a side elevation view of a clip attached to a truss member showing the rotational insertion engagement of a cross-brace therein.

In use, and referring to FIGS. 1 and 4, clip 24 is attached to chord member 28 of truss 22 with fasteners 58 such that tab 54 rests on a top edge of chord member 28. First and second fingers 34 and 36 extend vertically above the top of chord member 28. A plurality of clips 24 are attached in like manner to adjacent trusses 22 along a common axis as shown in FIG. 1. Cross-brace 26 is positioned such that notches 70 and 72 are aligned with respective chord members 28 of adjacent trusses 22. Leg 60 of cross-brace 26 is engaged in slot 48 of clips 24. Cross-brace 26 is rotated about its longitudinal axis as shown by directional arrow "A" until top edge 62 of leg 60 abuts shoulder 42 and top edge 66 of leg 64 is rotated past shoulder 44. The U-shaped cross-section of cross-brace 26 renders legs 60 and 64 resilient one with respect to the other such that as cross-brace 26 is rotated, nib 40 on second finger 36 deflects leg 64 toward leg 60. When top edge 66 rotates below shoulder 44, the resilience of cross-brace 26 expands leg 64 to engage shoulder 44, thus capturing cross-brace 26 within clip 24 and retaining cross-brace 26 onto chord member 28 in a snap-in manner. Trusses 22 are further laterally braced and spaced as a result of notches 70 and 72 engaging chord member 28.

Figure 5:
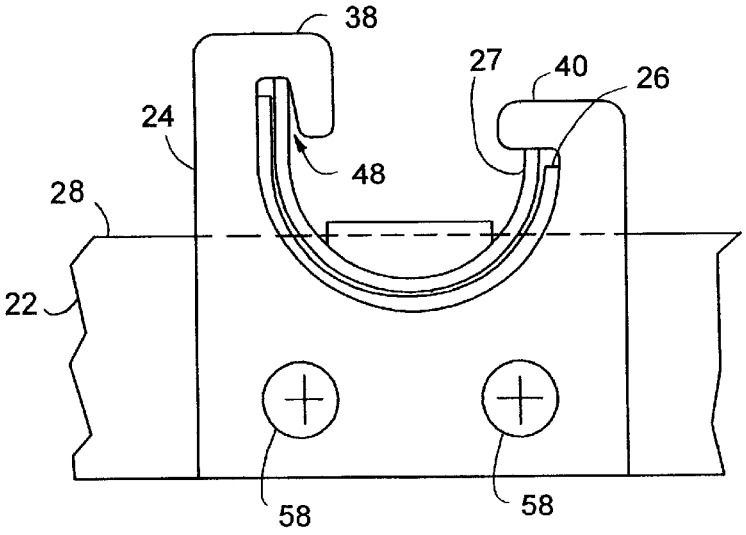
FIG. 5 is a side elevation view of a clip attached to a truss member illustrating nested cross-braces engaged therein.
Figure 6:
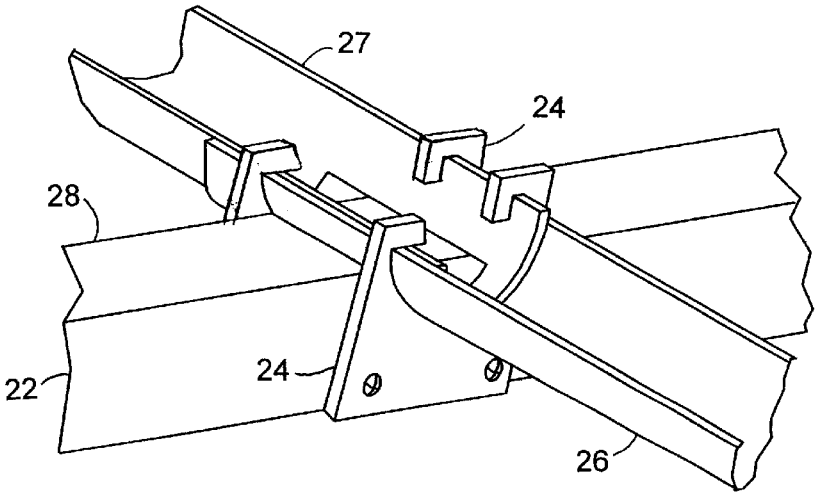
FIG. 6 is a perspective view of a segment of a truss having a clip attached to both sides of the truss member with nested cross-braces engaged therewith.
Figure 7:
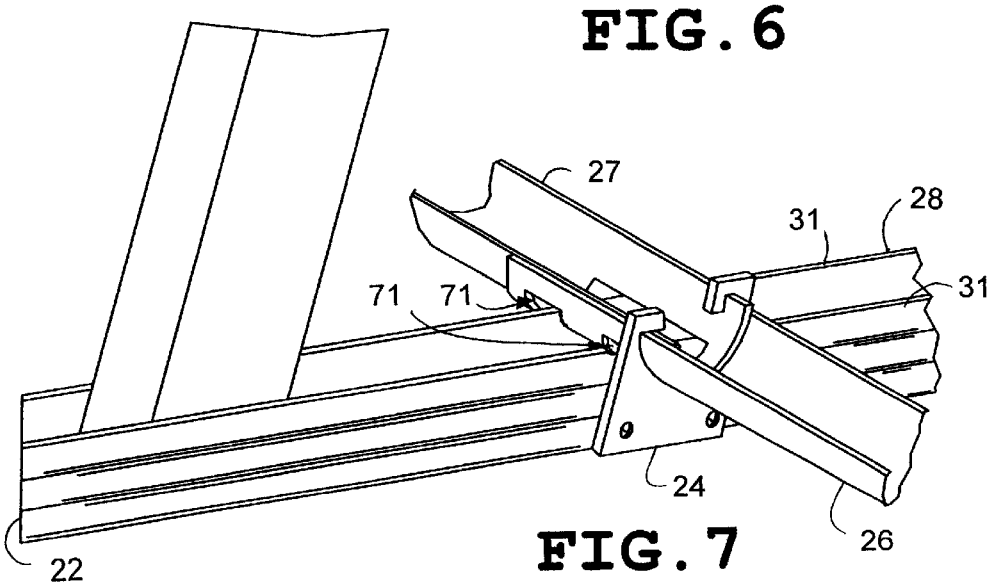
FIG. 7 is a perspective view of a segment of a truss having one clip attached to a side thereto and having nested cross-braces engaged therewith.

Referring to FIGS. 5–7, The length of cross-brace 26 is recognized to have practical limits such that a single cross-brace 26 would not be feasible to extend the entire length of a building. In order to maintain consistent bracing between successive trusses 22, the cross-bracing function must be carried from one cross-brace to the next. This can be accomplished by offsetting or nesting successive cross-braces 26 one from the other along respective trusses 22. One advantage of cross-bracing system 20 is that clips 24 can be pre-installed at designated positions on trusses 22 during manufacture of the trusses, thereby minimizing installation activities during construction of the building. If clips 24 are pre-installed, it is desirable to have all like positioned clips 24 along a common axis, therefore rendering each truss 22 as near identical as possible to maintain simplicity in placing and arranging trusses 22 on the building. As shown in FIGS. 5–7, adjoining ends of successive cross-braces can be nested within each other and in clips 24 such as one end of cross-brace 27 nested in a bridging end of cross-brace 26. Nibs 38 and 40 of clips 24 are of sufficient length to define a slot 48 capable of receiving two legs of a cross-brace at one end of clip 24 and a shoulder 44 capable of retaining two top edges of a leg at an opposite end of clip 24. As shown in FIG. 6, a clip 24 can be attached to each face of chord member 28 to receive the ends of cross-braces 26 and 27. FIG. 7 discloses that instead of one large notch, such as notch 70 or 72 as shown in FIG. 3, cross-braces 26 and 27 can include two narrow notches 71 to engage individual flanges of chord member 28 when a metal truss 22 incorporates metal U-channel truss members.

Figure 8:
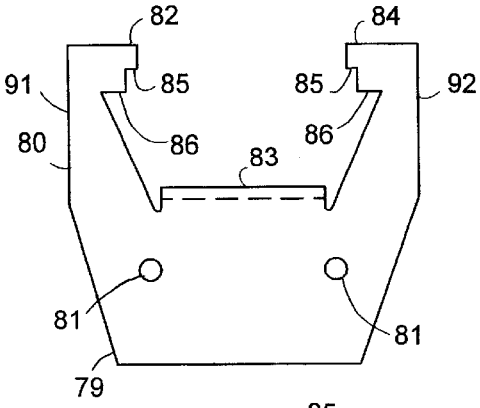
FIG. 8 is an alternate embodiment of a clip for attaching to a side of a truss having multiple shoulder for engaging the edges of nested cross-braces.
Figure 9:
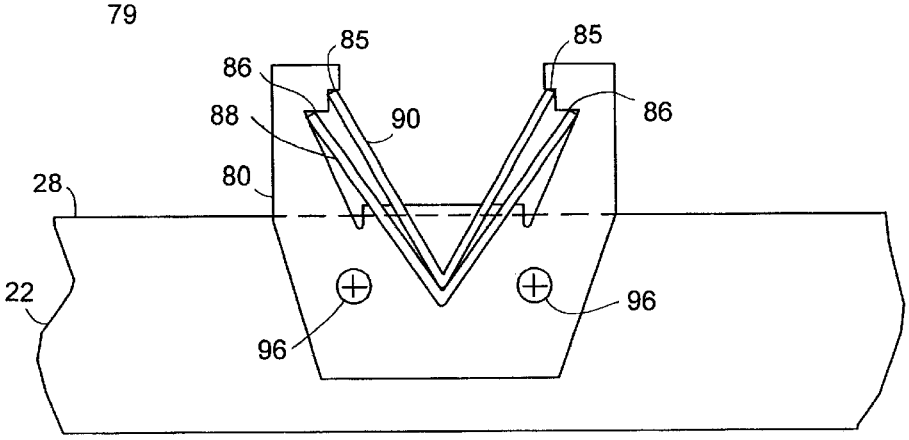
FIG. 9 is a side elevation view of a clip according to FIG. 8 having engaged therein nested V-shaped cross-braces.
Figure 10:
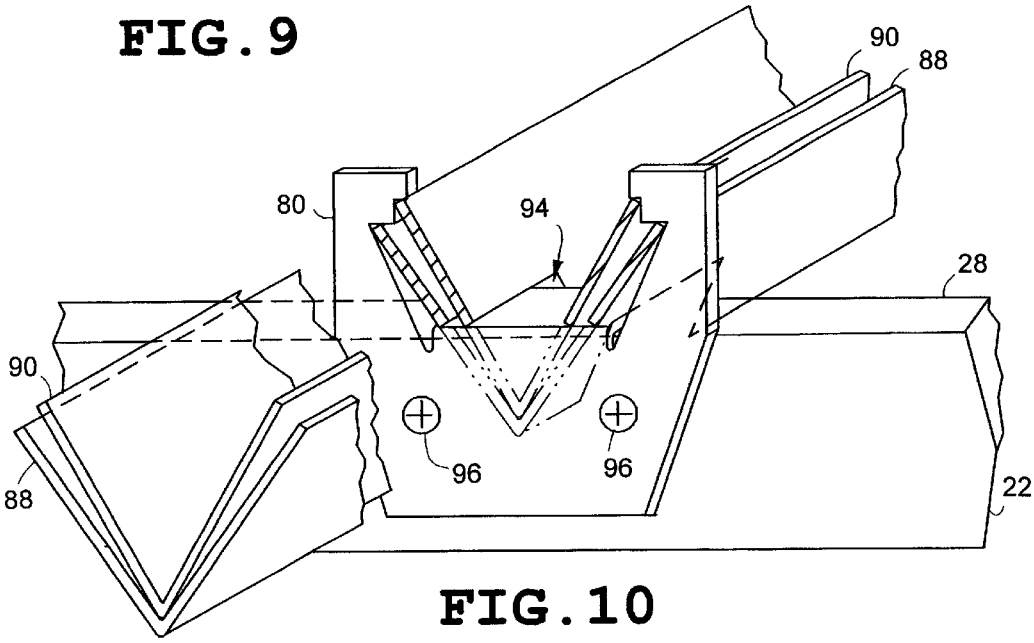
FIG. 10 is a partially broken perspective view of a set of nested V-shaped cross-braces engaged in a clip according to FIG. 8.

Referring now to FIGS. 8–10, FIG. 8 discloses an alternate embodiment clip 80 with an attachment portion 79 including attachment holes 81 therethrough for attachment to member 28 with fasteners 96 and tab 83 extending at a right angle from portion 79 for positioning on a top edge of a truss chord member 28. Clip 80 has a first finger 91 and second finger 92 of substantially equal lengths extending vertically from attachment portion 79. Each finger 91 and 92 has a similar nib 82 and 84 respectively, and each nib, in turn, defines along a bottom edge two shoulders 85 and 86 which are horizontally and vertically offset one from the other for receiving legs of nested cross-braces. FIG. 9 shows V-shaped cross-brace 90 nested in V-shaped cross-brace 88 wherein the top edges of cross-brace 88 bear on shoulders 86 and the top edges of cross-brace 90 bear on shoulders 85. V-shaped cross-braces 88 and 90 are notched with notches 94 similarly to notches 70 ad 72 in U-shaped cross-brace 26 as shown in FIG. 10.

Figure 11:
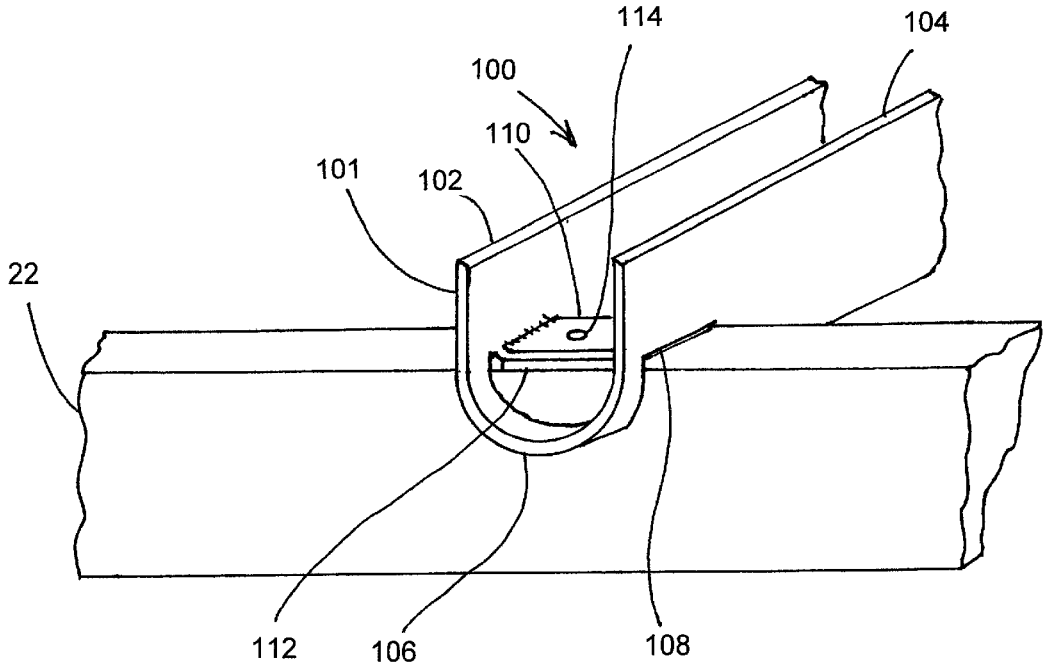
FIG. 11 is a partial perspective view of another alternative embodiment of a cross-brace engaged with a truss member.

FIG. 11 discloses an alternate embodiment cross-brace 100 shown as a U-cross section although alternate cross-sectional configurations as described above are applicable as well to cross-brace 100. Cross-brace 100 has a first leg 102 and a second leg 104 which are interconnected at a lower portion by bottom 106. Cross-brace 100 also includes a notch 108 at each end, although only one end 101 is shown in FIG. 11. Notch 108 is formed by cutting the length of notch 108 to its desired depth, and then bending upwardly a tab portion 110 from leg 102 to define a top of notch 108. A second tab portion 112 can be formed from leg 104 in a like manner. Tab portions 110 and 112 can be fastened together with any suitable fastener 114, such as a rivet, a screw, or other known fastener for use in the cross-brace system 20 described above. Alternatively, cross-brace 100 can be used without clip 24 and fastened directly to truss 22 with fastener 114 which can be a rivet, a screw, or other fastener used in the construction art.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A cross-bracing kit for laterally spacing and bracing open web structural supports, said kit comprising:

at least two clips, each of said clips includes an attachment portion for attaching to a truss member and a first finger and a second finger extending in parallel cantilevered fashion from said attachment portion and defining a channel therebetween, each of said fingers including a nib at a free end of said finger, said nibs facing each other and defining an opening therebetween narrower than said channel; and at least one cross-brace having a channel-like cross section including a first leg and a second leg connected at their respective bottoms and further including at least two notches in a bottom of said brace, said notches separated one from the other a distance corresponding to a desired spacing of adjacent truss members.

2. The cross-bracing kit according to claim 1, wherein a width of said cross-brace is greater than a distance separating said nibs.

3. The cross-bracing kit according to claim 2, wherein a bottom of each of said nibs defines a shoulder for capturing a top edge of one of said first and said second legs.

4. The cross-bracing kit according to claim 3, wherein a length of said first leg from said notch to a top edge of said first leg is substantially equal to a length of said first finger from a bottom of said channel to said shoulder of said first nib, and a length of said second leg from said notch to a top edge of said second leg is substantially equal to a length of said second finger from a bottom of said channel to said shoulder of said second nib.

5. The cross-bracing kit according to claim 4, wherein said first finger is longer than said second finger.

6. The cross-bracing kit according to claim 5, wherein said nib on said first finger includes a depending portion, said depending portion in combination with a portion of said first finger defines a slot therebetween.

7. The cross-bracing kit according to claim 3, wherein said bottom of each of said nibs defines a first shoulder and a second shoulder, said first shoulder laterally and vertically offset from said second shoulder.

8. The cross-bracing kit according to claim 1, wherein said clip further includes a tab at a bottom of said channel defined by said fingers and extends at a right angle from said attachment portion.

9. The cross-bracing kit according to claim 1, wherein said cross section of said crossbrace is a U-shape.

10. The cross-bracing kit according to claim 1, wherein said cross section of said crossbrace is a V-shape.

11. The cross-bracing kit according to claim 1 wherein at least one of said notches has a top defined by a tab portion projecting inwardly from at least one of said legs.

12. The cross-bracing kit according to claim 11 wherein said top is defined by a tab portion projecting inwardly from each of said legs.

13. The cross-bracing kit according to claim 12 wherein said tab portions overlap and are fastened one to the other.

14. The cross-bracing kit according to claim 13 wherein said tab portions are fastened with rivets.

15. A cross-braced open web structural support system comprising:

at least two open web structural supports separated one from the other;

at least one clip attached to each support, each of said clips includes an attachment portion abutting a first surface of said support and further includes a first finger and a second finger extending in parallel cantilevered fashion from said attachment portion and defining a channel therebetween, each said finger including a nib at a free end of said finger, said nibs facing each other and defining an opening therebetween narrower than said channel; and at least one cross-brace extending between said at least two supports, said brace having a channel-like cross section including a first leg and a second leg connected at their respective bottoms and further including at least two notches in a bottom of said brace, each said notch engaging one of said clips and a portion of one of said supports, said notches separated one from the other a distance corresponding to a desired spacing of adjacent supports.

16. The cross-braced open web structural support system according to claim 15, wherein a width of said cross-brace is greater than a distance separating said nibs.

17. The cross-braced open web structural support system according to claim 15, wherein a bottom of each said nib defines a shoulder and further wherein said shoulder captures a top edge of one of said first or said second legs.

18. The cross-braced open web structural support system according to claim 17, wherein a length of said first leg from said notch to a top edge of said first leg is substantially equal to a length of said first finger from a bottom of said channel to said shoulder of said first nib, and a length of said second leg from said notch to a top edge of said second leg is substantially equal to a length of said second finger from a bottom of said channel to said shoulder of said second nib.

19. The cross-braced open web structural support system according to claim 18, wherein said first finger is longer than said second finger.

20. The cross-braced open web structural support system according to claim 19, wherein said nib on said first finger includes a depending portion, said depending portion in combination with a portion of said first finger defines a slot therebetween, and said first leg is engaged within said slot.

21. The cross-braced open web structural support system according to claim 17 wherein said bottom of each said nib defines a first shoulder and a second shoulder, said first shoulder laterally and vertically offset from said second shoulder, said first shoulders engaging respective top edges of a first of said at least one elongate cross-braces, and said second shoulders engaging respective top edges of a second of said at least one elongate cross-braces.

22. The cross-braced open web structural support system according to claim 15 wherein said clip further includes a tab at a bottom of said channel defined by said fingers and extends at right angles from said attachment portion, said tab abutting a second surface of said support.

23. The cross-braced open web structural support system according to claim 15 wherein said cross-section of said cross-brace is a U-shape.

24. The cross-braced open web structural support system according to claim 15 wherein said cross-section of said cross-brace is a V-shape.

25. The cross-braced open web structural support system according to claim 15 wherein at least one of said notches has a top defined by a tab portion projecting inwardly from at least one of said legs.

26. The cross-braced open web structural support system according to claim 25 wherein said top is defined by a tab portion projecting inwardly from each of said legs.

27. The cross-braced open web structural support system according to claim 26 wherein said tab portions overlap and are fastened one to the other.

28. The cross-braced open web structural support system according to claim 27 wherein said tab portions are fastened with a fastener.

29. A cross-braced open web structural support system comprising:

at least two open web structural supports separated one from the other;

at least one cross-brace extending between said at least two supports, said brace having a channel-like cross section including a first leg and a second leg connected at their respective bottoms and further including at least two notches in a bottom of said brace, each said notch having a top defined by a tab portion projecting inwardly from at least one of said legs, each said notch engaging a portion of one of said supports; and a fastener affixing said top to said support.

30. The cross-braced open web structural support system according to claim 29 wherein said top is defined by a tab portion projecting inwardly from each of said legs.

31. The cross-braced open web structural support system according to claim 30 wherein said tab portions overlap and said fastener affixes both tab portions to said support portion.

32. The cross-braced open web structural support system according to claim 31 wherein said fastener is a rivet.

33. A method of cross-bracing open web structural support comprising the steps:

attaching at least one clip to each of a plurality of supports, each clip includes an attachment portion abutting a first surface of the support and further includes a first finger and a second finger extending in parallel cantilevered fashion from the attachment portion and defining a channel therebetween, each finger includes a nib at a free end of the finger, the nibs facing each other and defining an opening therebetween narrower than the channel;

arranging said supports in a desired placement wherein at least adjacent clips are laterally aligned one with the other when the supports are in their desired placement;

placing an elongate cross-brace extending between at least two adjacent supports, wherein the cross-brace has a channel-like cross-section including a first leg and a second leg connected at their respective bottoms and further includes at least two notches in a bottom of the brace, the notches separated one from the other a distance corresponding to a desired spacing of adjacent trusses, each notch aligned with one of the supports;

engaging the cross-brace in the clip channel such that each notch engages a portion of a respective support and the finger nibs of each clip engage respective legs of the cross-brace.

34. The method according to claim 33 wherein:

the attaching step includes a clip having the first finger longer than the second finger and further having a depending portion from the first nib to define a slot between the first finger and the depending portion;

the placing step includes a cross-brace having a first leg longer that the second leg; and wherein the engaging step comprises the steps of:

inserting the first leg of the cross-brace in the slot defined by the first finger and the depending portion of the first nib;

rotating the cross-brace about its longitudinal axis to insert the portion of each respective support in each notch; and snapping a top edge of the second leg under the nib of the second finger.

* * * * *